US009573142B2

(12) United States Patent
Zhou et al.

(10) Patent No.: US 9,573,142 B2
(45) Date of Patent: Feb. 21, 2017

(54) HANDLE ROTATING SWITCH SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Huasong Zhou, Fujian (CN); Wenxing Chen, Fujian (CN); Donghai Chen, Fujian (CN); Guoqiang Wu, Fujian (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 14/786,774

(22) PCT Filed: May 26, 2014

(86) PCT No.: PCT/CN2014/078407

§ 371 (c)(1),
(2) Date: Oct. 23, 2015

(87) PCT Pub. No.: WO2014/190881

PCT Pub. Date: Dec. 4, 2014

(65) Prior Publication Data

US 2016/0074883 A1 Mar. 17, 2016

(30) Foreign Application Priority Data

May 27, 2013 (CN) ..... 2013 1 0202131
May 27, 2013 (CN) ..... 2013 2 0296796 U

(51) Int. Cl.
*B05B 1/16* (2006.01)
*B05B 1/18* (2006.01)

(52) U.S. Cl.
CPC ..... *B05B 1/1636* (2013.01); *B05B 1/18* (2013.01)

(58) Field of Classification Search
CPC ..... B05B 1/1636; B05B 1/169; B05B 1/18
(Continued)

(56) References Cited

U.S. PATENT DOCUMENTS 5,918,816 A 7/1999 Huber
6,981,661 B1 * 1/2006 Chen ..... B05B 1/1636 239/442
(Continued)

FOREIGN PATENT DOCUMENTS

CN 201140131 Y 10/2008
CN 201692892 U 1/2011
(Continued)

*Primary Examiner* — Darren W Gorman
(74) *Attorney, Agent, or Firm* — Rabin & Berdo, P.C.

(57) ABSTRACT

A handle rotating switch shower head has a head portion, a water diversion body, a spindle and a handle. The head portion has at least two outlet functions and at least two inlets, the water diversion body is fixedly assembled to the head portion, the water diversion body is disposed with at least two sets of water diversion holes and at least two water diversion cavities, each set of the water diversion holes corresponds to one water diversion cavity, the water diversion cavities insert to the head portion and each water diversion cavity is connected to one inlet; the spindle is pivoted joint to the water diversion body, it has an inlet passage, the spindle rotating to drive the inlet passage to switch to connect to the water diversion holes; the handle is rotatable with respect to the water diversion body and is fixed with respect to the spindle.

9 Claims, 6 Drawing Sheets

(58) Field of Classification Search
USPC ..... 239/444–449, 525, 562, 563, 581.1
See application file for complete search history.

(56) References Cited

U.S. PATENT DOCUMENTS

| | | | | |
|---|---|---|---|---|
| 7,156,325 | B1 * | 1/2007 | Chen | B05B 1/1636 239/391 |
| 7,992,806 | B2 * | 8/2011 | Qiu | B05B 1/1636 239/442 |
| 8,297,538 | B2 * | 10/2012 | Zhou | B05B 1/1636 239/391 |
| 2006/0016913 | A1 * | 1/2006 | Lo | B05B 1/1636 239/532 |
| 2008/0156902 | A1 * | 7/2008 | Luettgen | B05B 1/1636 239/447 |
| 2011/0147490 | A1 * | 6/2011 | Chen | B05B 1/12 239/289 |
| 2013/0254985 | A1 * | 10/2013 | Zhou | B05B 1/18 4/615 |

FOREIGN PATENT DOCUMENTS

| | | | |
|---|---|---|---|
| CN | 202097046 | U | 1/2012 |
| CN | 202752111 | U | 2/2013 |
| CN | 203316285 | U | 12/2013 |
| DE | 10232463 | A1 | 1/2004 |

* cited by examiner

HANDLE ROTATING SWITCH SHOWER HEAD

FIELD OF THE INVENTION

The present invention relates to a rotating switch shower head, especially to a shower head with the rotating switch on the handle.

BACKGROUND OF THE INVENTION

An outlet switch device of a shower head is disclosed in the Chinese patent database with announcement number CN201140131Y, therein the inlet port of the shower head main body is disposed with a plurality of inlets corresponding to different water diversion cavities, a connecting element is disposed between the handle of the shower head and the inlet port of the main body, the front end face of the connecting element is disposed with an outlet hole corresponding to the inlets, the connecting element is axially pivoted joint to the inlet port of the main body, the connecting element is fixed to the handle in sealing way. The handle can rotate with respect to the main body, so as to drive the connecting element to rotate to make the outlet hole switched to connect to different inlets of the main body. With this proposal, the inlet port of the main body is disposed with a plurality of water diversion cavities, making the inlet port of the main body with complicated structure, thick and uneven wall, so that appearance defect like shrinking easily happens during injection molding, and the inlet port of the main body has a large size.

SUMMARY OF THE INVENTION

The present invention is provided with a handle rotating switch shower head, which overcomes the disadvantages of the existing known technology. The technical proposal of the present invention is that: a handle rotating switch shower head, comprising:

a head portion (100) with at least two outlet functions and at least two inlets (110), each of which is corresponding to one outlet function;

a water diversion body (200) assembled to the head portion (100), the water diversion body (200) has at least two sets of water diversion holes and at least two water diversion cavities (210), each set of the water diversion holes is corresponding to one water diversion cavity (210), the water diversion cavities (210) are inserted to the head portion (100) and each water diversion cavity (210) is connected to one inlet (110) correspondingly;

a spindle (300) pivoted joint to the water diversion body (200), the spindle (300) has an inlet passage (310), the spindle (300) rotates to drive the inlet passage (310) to switch to connect to the water diversion holes; and a handle (400) being able to rotate with respect to the water diversion body (200) and fixed with respect to the spindle (300), the handle (400) is connected to the spindle (300) and the water diversion body (200) in sleeving way.

In another preferred embodiment, it further comprises a sealing element (500), the sealing element (500) is disposed to the spindle (300), the spindle (300) rotates to make the sealing element (500) close one set of water diversion holes or close part of the water diversion holes of at least two sets of the water diversion holes at the same time.

In another preferred embodiment, the head portion (100) comprises a main body (120) and a cover component (130) disposed to the main body (120), the inlets (100) are disposed to the cover component (130), the main body (120) is disposed with a hollow connecting portion (121), the inlets (110) are corresponding to the connecting portion (121), the water diversion cavities (210) extend out of the handle (400) and run through the connecting portion (121) to insert to the main body (120), the water diversion cavities (210) are connected to the inlets (110).

In another preferred embodiment, an annular lock groove (211) is disposed at the outer periphery of the water diversion cavity (210), the lock groove (211) is disposed in the main body (12), a lock element (600) is further disposed, the lock element (600) is locked to the lock groove (211), the lateral width of the lock element (600) is larger than that of the connecting portion (121).

In another preferred embodiment, a protruding block (122) is disposed at the inner wall of the connecting portion (121), two adjacent water diversion cavities (210) of the water diversion body (200) is disposed with a groove (212) which can be coupled to the protruding block (122).

In another preferred embodiment, the water diversion body (200) comprises a sleeve portion (220), the bottom end face of the sleeve portion (220) is disposed with the water diversion holes, the water diversion cavities (210) are connected to the sleeve portion (220), one end of the spindle (300) inserts to the sleeve portion (220), while the other end extends out of the sleeve portion (220), the handle (400) is sleeved on the outer side of the spindle (300) and the sleeve portion (220), the periphery wall of the sleeve portion (220) is disposed with a through groove (221), the outer periphery of the end of the spindle (300) inserted to the sleeve portion (220) is disposed with an annular stop groove (320), a stop element (330) is further disposed to limit the spindle (300) in the axial direction, the stop element (330) is assembled to the stop groove (320) and is lock connected to the through grove (221).

In another preferred embodiment, the top end portion of the sleeve portion (220) is disposed with a stop block (222), the outer periphery of the spindle (300) is protruding with two stop ribs (340) which can contact with and couple to the stop block (222) so as to limit the rotating angle of the spindle (300).

In another preferred embodiment, the inner periphery face of the handle (400) is protruding with an elongated protruding rib (410), the outer periphery of the spindle (300) is disposed with an elongated groove (350)which can be coupled to the protruding rib (410).

In another preferred embodiment, the outer periphery of the end of the spindle (300) inserted to the sleeve portion (220) is concaved with an assembly chamber (360), the sleeve portion (220) is disposed with at least three lock holes (223), a lock pin (224) and a spring (225) are further disposed, the lock pin (224) is movably assembled to the assembly chamber (360) and can be coupled to the lock holes (223) respectively, the spring (225) abuts against between the lock pin (224) and the assembly chamber (360).

In another preferred embodiment, it comprises two sets of water diversion holes: a first water diversion hole set and a second water diversion hole set, the first water diversion hole set comprises two pairs of first water diversion holes (230), the second water diversion hole set comprises two pairs of second water diversion holes (240); and two water diversion cavities (210), two inlets (110) and two outlet functions.

Comparing to the existing known technology, the technical proposal of the present invention has advantages as follows:

1. rotating the handle can drive the spindle to rotate with respect to the water diversion body so as to implement function switch, that is to say, the switch device is disposed in the handle, the head portion can be very thin; in addition, the switch device formed by the handle, the spindle and the water diversion body can couple to head portions with different appearance, so that it has well commonality performance.
2. with the sealing element, the spindle rotates to drive the sealing element to close one set of the water diversion holes to make the inlet passage connect to the other set of the water diversion holes, with this closing mode, it needs light switch force, and it can obtain well switch hand feel.
3. the shower head main body is disposed with a connecting portion, the water diversion cavity extends out of the handle and runs through the connecting portion to insert to the main body, the water diversion cavities are connected to the inlets, so that the head portion, especially the main body, can be thinner and more even wall, and it has a higher yield during manufacturing.
4. with the cooperation of the lock element and the lock groove, the water diversion cavity is movement limited in the axial direction, with the cooperation of the protruding block and the groove, the water diversion cavity is movement limited in the radial direction, so that the water diversion cavity, the water diversion body, is fixed with respect to the head portion, the structure is simple, and it doesn't occupy the space of the head portion additionally, so that the head portion can be designed small and exquisite.
5. with the cooperation of the stop element, the stop groove and the through groove, it limits the movement of the spindle in the axial direction, the stop structure is simple and low cost.
6. with the cooperation of the protruding rib and the elongated groove, the spindle and the handle can rotate synchronously, the structure is simple.
7. with the cooperation of the lock pin and the lock holes, it has a gear effect during switch, so that it has well switch hand feel.

BRIEF DESCRIPTION OF THE DRAWINGS

The present invention will be further described with the drawings and the embodiments.

DETAILED DESCRIPTION OF THE EMBODIMENTS

Figure 1:
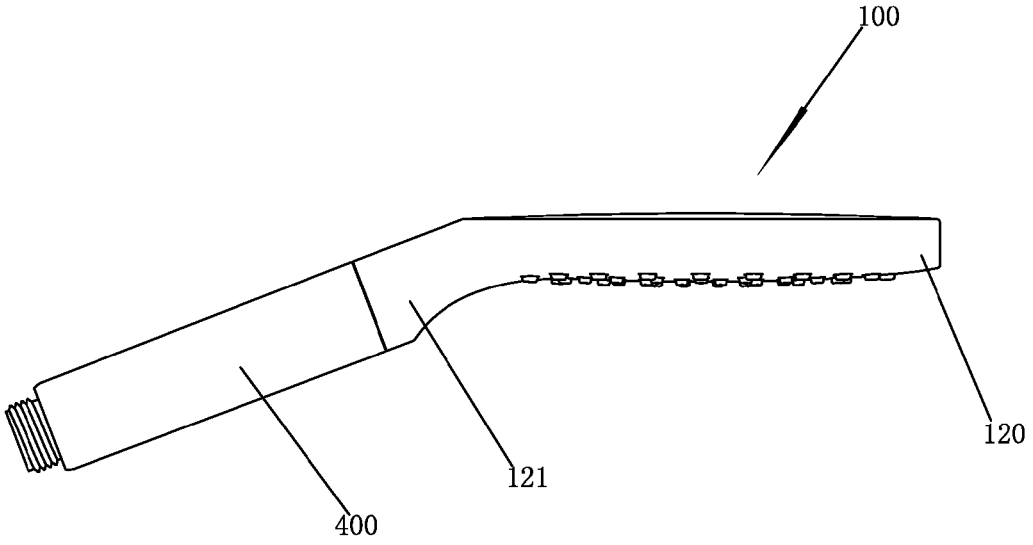
FIG. 1 illustrates a schematic diagram of the handle rotating switch shower head of a preferred embodiment of the present invention.
Figure 2:
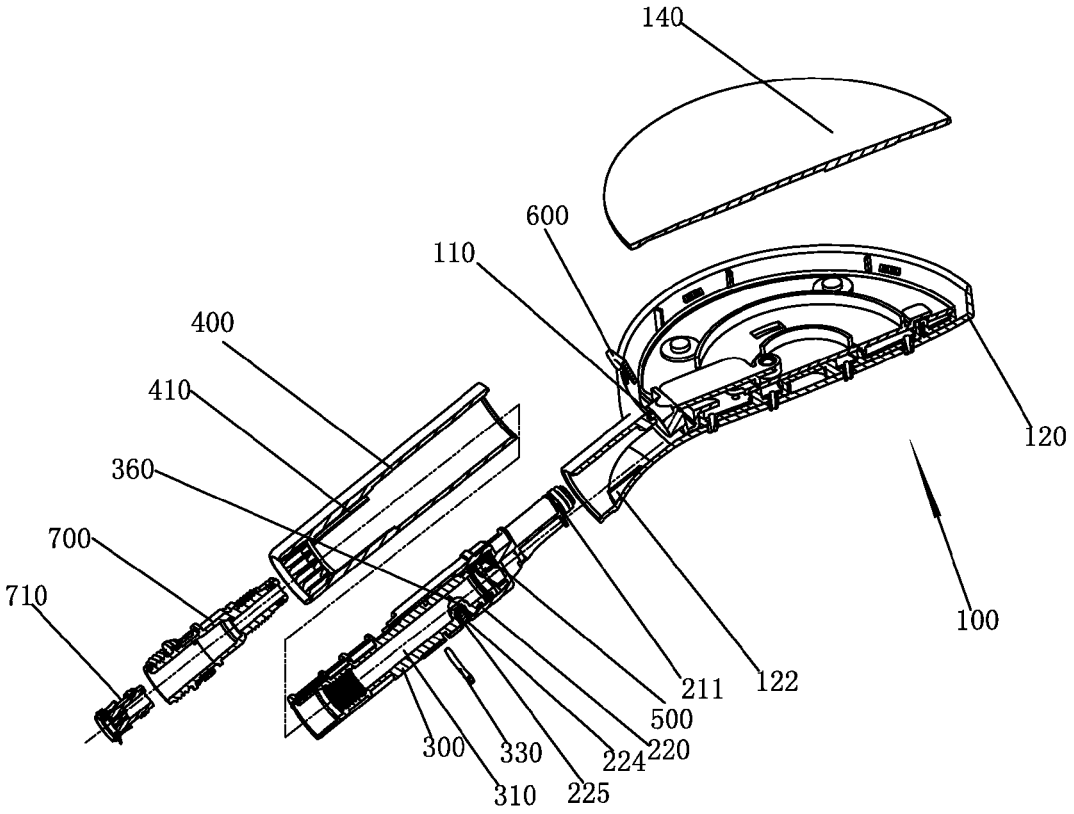
FIG. 2 illustrates a sectional exploded schematic diagram of the handle rotating switch shower head of the preferred embodiment of the present invention.
Figure 3:
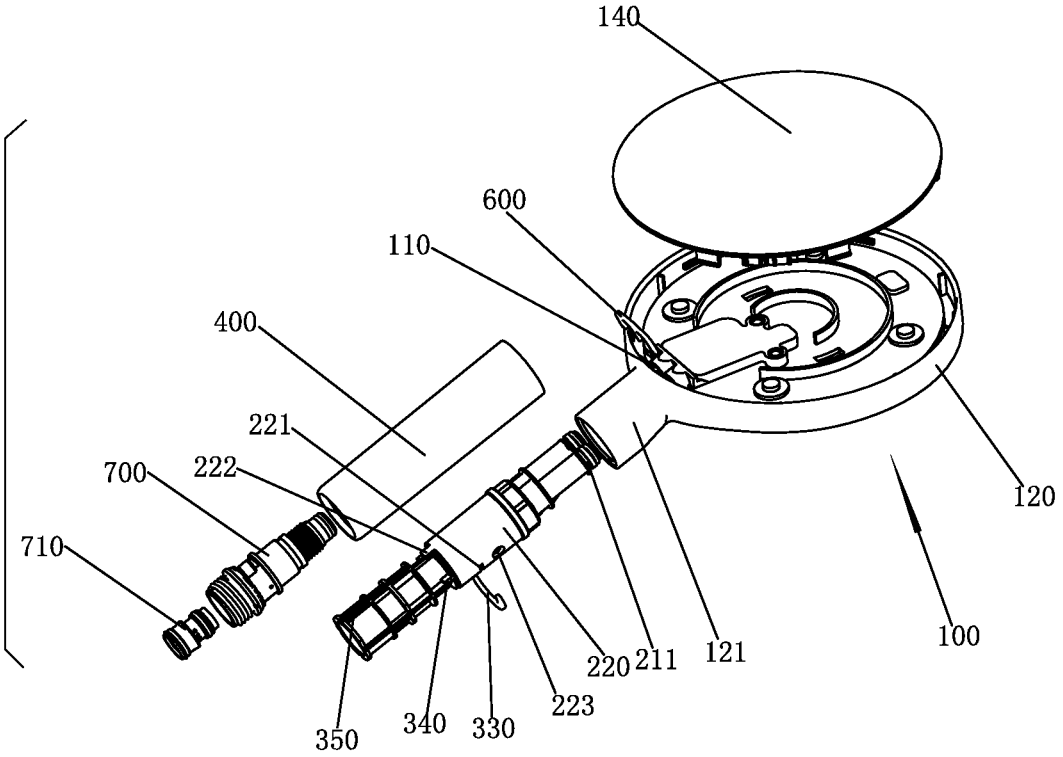
FIG. 3 illustrates an exploded and schematic diagram of the handle rotating switch shower head of the preferred embodiment of the present invention.
Figure 4:
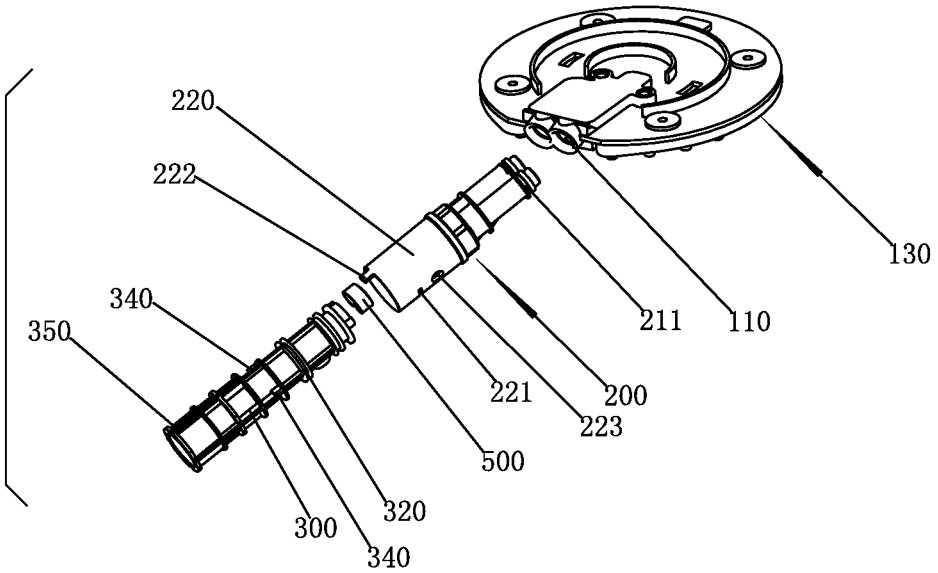
FIG. 4 illustrates a schematic diagram of partial structure of the shower head of the preferred embodiment of the present invention.
Figure 5:
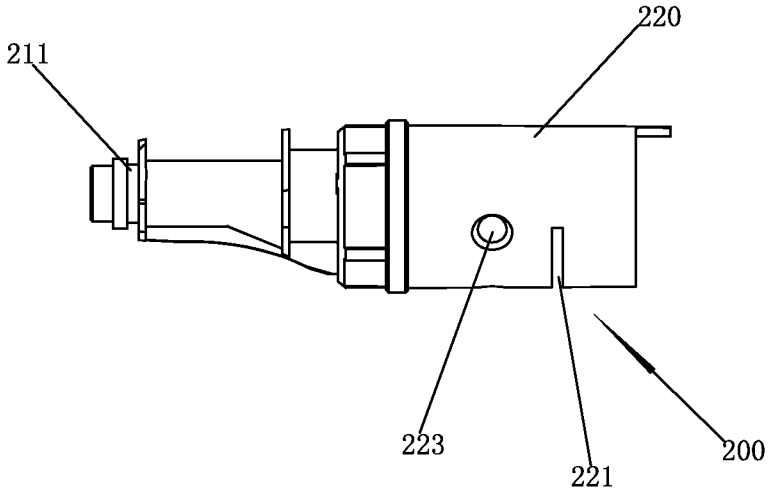
FIG. 5 illustrates a side view of the water diversion body of the preferred embodiment.
Figure 6:
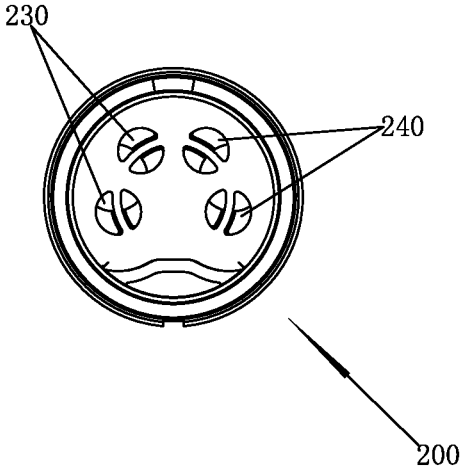
FIG. 6 illustrates a top view of the water diversion body of the preferred embodiment.
Figure 7:
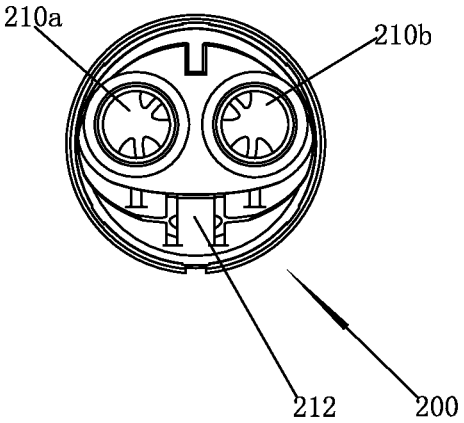
FIG. 7 Illustrates a bottom view of the water diversion body of the preferred embodiment.

Please referring to FIG. 1 to FIG. 13, the handle rotating switch shower head of the preferred embodiment comprises a head portion 100, a water diversion body 200, a spindle 300 and a handle 400.

The head portion 100 has at least two outlet functions and at least two inlets 110, each of which is corresponding to one outlet function. In this embodiment, the head portion 100 comprises shower head main body 120, a cover component 130 fixedly connected to the main body 120 and a rear cover 140, the rear cover covers 140, the main body 120 and forming an accommodating chamber, the cover component 130 is disposed in the accommodating chamber. There are two inlets 110 which are disposed at the cover component 130, there are also two outlet functions, one inlet 110 corresponds to one outlet function of the cover component.

In this embodiment, the shower head main body 120 is disposed with a hollow connecting portion 121, two inlets 110 are respectively corresponding to the connecting portion 121. The inner wall of the connecting portion 121 is disposed with a protruding block 122.

The water diversion body 200 is fixedly assembled to the head portion 100, it is disposed with at least two sets of water diversion holes and at least two water diversion cavities 210, each set of the water diversion holes is corresponding to a water diversion cavity 210, the water diversion cavities 210 insert to the head portion 100 and one water diversion cavity 210 is connected to one inlet 110. in this embodiment, there are two water diversion cavities 210 that are a first water diversion cavity 210*a*, and a second water diversion cavity 210*b*, there are two sets of water diversion holes that are a first water diversion hole set and a second water diversion hole set, the first water diversion hole set is disposed with two pairs of first water diversion holes 230, the second water diversion hole set is disposed with two pairs of second water diversion holes 240, two adjacent pairs of the first water diversion holes are spaced arranged, two adjacent pairs of the second water diversion holes are spaced arranged.

In this embodiment, the water diversion body 200 comprises a sleeve portion 220, the bottom end face of the sleeve portion 220 is disposed with the water diversion holes, the water diversion cavities 210 are fixedly connected to the bottom portion of the sleeve portion 220. The periphery of the sleeve portion 220 is disposed with a through groove 221, a groove 212 coupled to the protruding block 122 is disposed between two adjacent water diversion cavities 210, with the protruding block and the groove, it limits the movement of the water diversion cavities in the radial direction; the top portion of the sleeve portion 220 is disposed with a stop block 222, the periphery of the sleeve portion 220 is further disposed with at least three lock holes 223.

In this embodiment, the outer periphery of the first water diversion cavity 210*a*, and the second water diversion cavity 210*b*, is respectively disposed with an annular lock groove 211, the lock grooves 211 are disposed in the main body 120, a chevron shaped lock element 600 is further disposed, the opening end of the chevron shaped lock element 600 is downwardly locked to the two lock grooves 211, the lateral width of the lock element 600 is larger than the width of the connecting portion 121, with the lock element 600, the water diversion cavity 200 can not take off the main body. With the lock element and the lock groove, the water diversion cavities are move limited in the axial direction.

In this embodiment, two water diversion cavities 210 both run through the connecting portion 121 and insert to the main body 120, the water diversion cavities 210 are respectively connected to the inlets 110. in this embodiment, the end of the water diversion cavities 210 inserts to the inlets 110.

The spindle 300 is pivoted joint to the water diversion body 200, it is disposed with an inlet passage 310, the spindle 300 rotates to drive the inlet passage 310 to switch to connect to the water diversion holes. In this embodiment, one end of the spindle 300 inserts to the sleeve portion 200, while the other end extends out of the sleeve portion 220.

In this embodiment, the shower head further comprises a sealing element 500, which is fixedly connected to the end of the spindle 300 inserted to the sleeve portion, the spindle 300 rotates to drive the sealing element 500 to rotate so as to close one set of the water diversion holes or close part of the water diversion holes of the at least two sets of the water diversion holes. In this embodiment, the sealing element 500 can close the first water diversion hole set or the second water diversion hole set, or in other case, close one pair of the first water diversion holes and one pair of the second water diversion holes at the same time. When the first water diversion hole set is closed by the sealing element 500, the second water diversion hole set is connected to the inlet passage, the second water diversion cavity 210*b*, outflows water; When the second water diversion hole set is closed by the sealing element 500, the first water diversion hole set is connected to the inlet passage, the first water diversion cavity 210*a*, outflows water; when one pair of the first water diversion holes and one pair of the second water diversion holes are closed by the sealing element 500, the first and the second water diversion cavities outflow water at the same time.

In this embodiment, the outer periphery of the end of the spindle 300 inserted to the sleeve portion 220 is disposed with an annular stop groove 320, a stop element 330 is further disposed to limit the movement of the spindle 300 in the axial direction, the stop element 330 is assembled to the stop groove 320 and is locked to the through groove 221. with the stop element, the stop groove and the through groove, the spindle is movement limited in the axial direction, the stop structure is simple and low cost.

In this embodiment, the outer periphery of the end of the spindle 300 inserted to the sleeve portion is disposed with an assembly chamber 360, a lock pin 224 and a spring 225 are further disposed, the lock pin 224 is movably assembled to the assembly chamber 360 and it can work with the lock holes 223, the spring 225 abuts against between the lock pin 224 and the assembly chamber 360. with the cooperation of the lock pin, spring and the lock holes, it has gear feeling during switching, so that it has well switch hand feel.

In this embodiment, the outer periphery of the end of the spindle 300 extending out of the sleeve portion is protruding with two stop ribs 340 contacted with and coupled to the stop block 222 so as to limit the rotating angle of the spindle 300.

In this embodiment, the outer periphery of the end of the spindle extending out of the sleeve portion is disposed with an elongated groove 350.

The handle 400 is rotatable with respect to the water diversion body 200 and is fixed with respect to the spindle 300, the handle 300 is connected to the water diversion body 200 in sleeving way.

In this embodiment, the handle 400 is sleeved on the outer side of the spindle 300 and the sleeve portion 220.

In this embodiment, the inner periphery face of the handle 400 is protruding with an elongated protruding rib 410, the protruding rib 410 is coupled to the elongated groove 350. With the cooperation of the protruding rib and the elongated groove, the spindle and the handle rotate synchronously, the structure is simple.

In this embodiment, the shower head is further disposed with a connecting sleeve 700, the connecting sleeve 700 is disposed with an air suction valve 710, one end of the connecting sleeve 700 is thread connected to the end of the spindle 300 extending out of the sleeve portion, the other end of the connecting sleeve 700 extends out of the handle 400 to connect to a water pipe.

Figure 8:
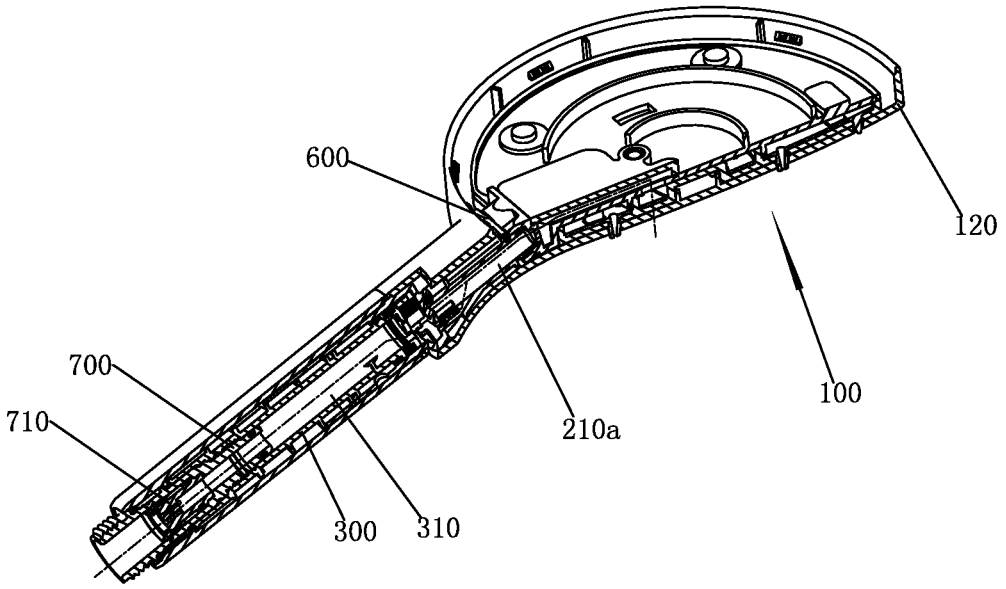
FIG. 8 illustrates a sectional diagram of the handle rotating switch shower head of the water diversion body of the preferred embodiment when the inlet passage is connected to the first water diversion holes.
Figure 9:
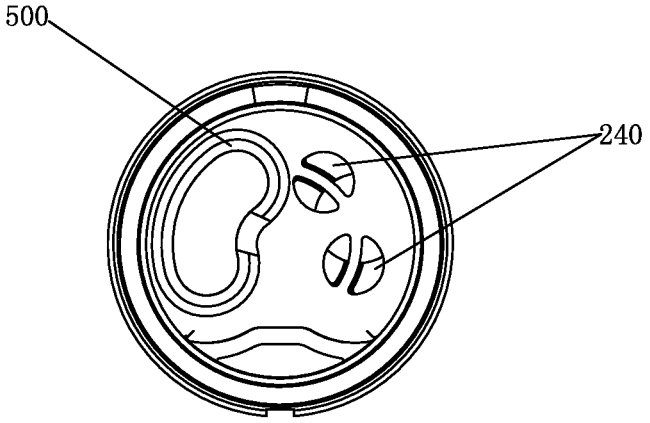
FIG. 9 illustrates a schematic diagram of the cooperation of the sealing element and the water diversion body of FIG. 8.

The working principle of the shower head is that:

As figured in FIG. 8 and FIG. 9, the sealing element 500 closes the first water diversion hole set, the second water diversion hole set is connected to the inlet passage, the second water diversion cavity 210*b*, outflows water, the outlet function corresponding to the second water diversion cavity 210*b*, outflows water.

Figure 10:
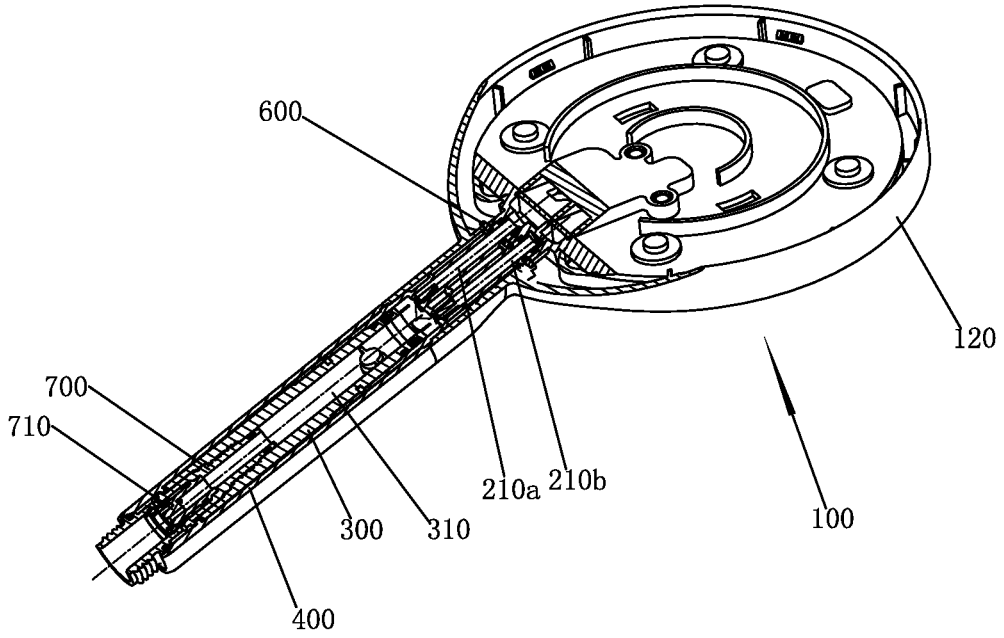
FIG. 10 illustrates a sectional diagram of the handle rotating switch shower head of the preferred embodiment when the inlet passage is connected to the first water diversion holes and the second water diversion holes at the same time.
Figure 11:
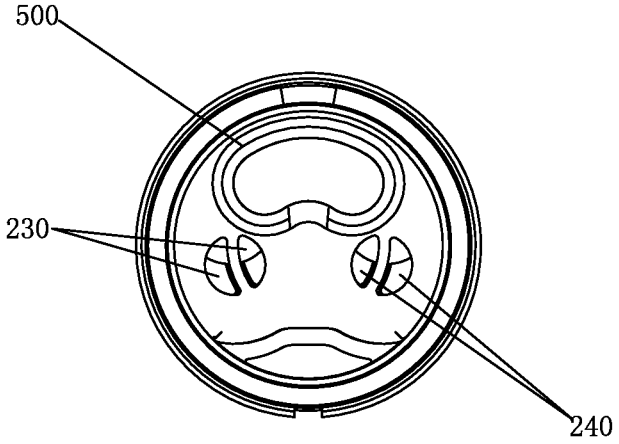
FIG. 11 illustrates the schematic diagram of the cooperation of the sealing element and the water diversion body of FIG. 10.

As figured in FIG. 10 and FIG. 11, when rotating the handle 400 in the clockwise direction, the handle 400 drives the spindle 300 to rotate synchronously, the sealing element 500 closes one pair of the first water diversion holes 230 of the first water diversion hole set and one pair of the second water diversion holes 240 of the second water diversion hole set at the same time by the driving of the spindle, at this time, the other pair of the first water diversion holes 230 and the other pair of the second water diversion holes 240 are respectively connected to the first water diversion cavity 210*a*, and the second water diversion cavity 210*b*, both outlet functions outflow water.

Figure 12:
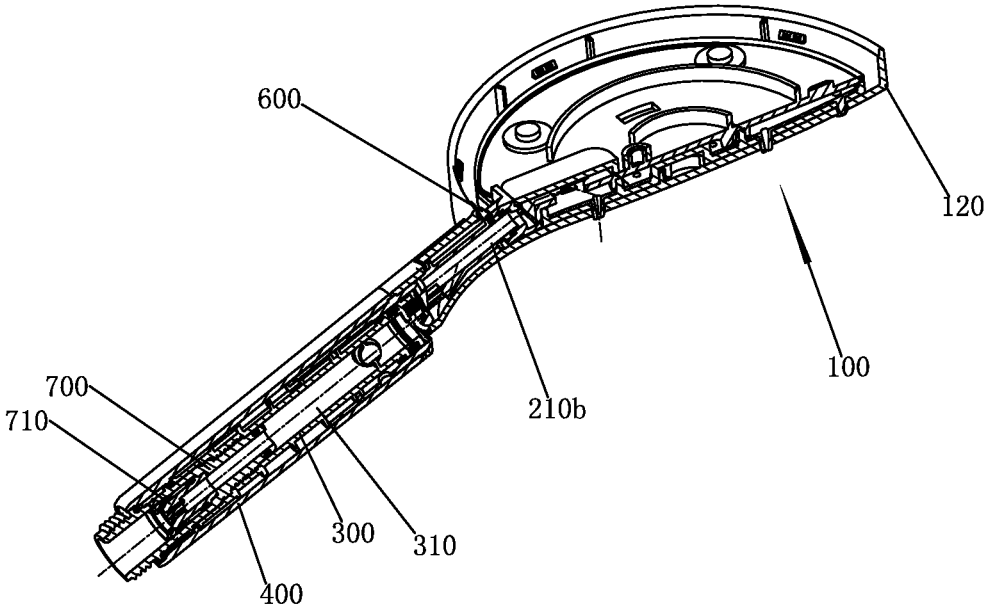
FIG. 12 illustrates a sectional diagram of the handle rotating switch shower head of the preferred embodiment when the inlet passage is connected to the second water diversion holes.
Figure 13:
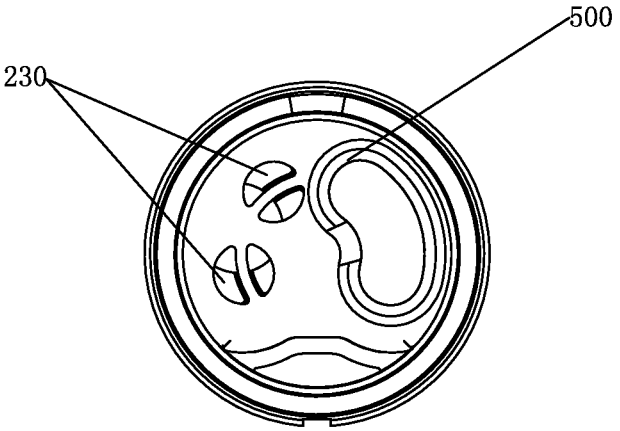
FIG. 13 illustrates a schematic diagram of the cooperation of the sealing element and the water diversion body of FIG. 12.

As figured in FIG. 12 and FIG. 13, when continuing rotating the handle 400 in the clockwise direction, the handle 400 drives the spindle 300 to rotate synchronously, the sealing element 500 closes the second water diversion hole set by the driving of the spindle, the first water diversion hole set is connected to the inlet passage, the first water diversion cavity 210*a*, outflows water, the outlet function corresponding to the first water diversion cavity 210*a*, outflows water.

As rotating the handle can drive the spindle to rotate with respect to the water diversion body so as to implement function switch, that is to say, the switch device is disposed in the handle, the head portion can be very thin; in addition, the switch device formed by the handle, the spindle and the water diversion body can couple to head portions with different appearance, so that it has well commonality performance.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is disposed with at least two outlet holes in the water diversion body to connect to the cover component by big and small holes, rotating the handle to drive the spindle to rotate with respect to the water diversion body so as to implement function switch, that is to say, the switch device is disposed in the handle, the head portion can be very thin; in addition, the switch device formed by the handle, the spindle and the water diversion body can couple to head portions with different appearance, so that it has well commonality performance.

The invention claimed is:

1. A handle rotating switch shower head, comprising:

a head portion with at least two outlet functions and at least two inlets, each of the at least two inlets corresponding to one of the at least two outlet functions;

a water diversion body assembled to the head portion, the water diversion body has at least two sets of water diversion holes and at least two water diversion cavities, each set of the at least two sets of water diversion holes corresponding to one of the at least two water diversion cavities, the at least two water diversion cavities are inserted into the head portion and each water diversion cavity is connected to one of the at least two inlets correspondingly;

a spindle pivotally connected to the water diversion body, the spindle has an inlet passage, the spindle rotates to drive the inlet passage to switch between the at least two sets of water diversion holes to connect to one of the at least two sets of water diversion holes; and a handle being able to rotate with respect to the water diversion body and fixed with respect to the spindle, the handle is connected to the spindle and the water diversion body in sleeving way, wherein the water diversion body comprises a sleeve portion, a bottom end face of the sleeve portion is provided with the water diversion holes, the water diversion cavities are connected to the sleeve portion, one end of the spindle inserts into the sleeve portion, while the other end extends out of the sleeve portion, the handle is sleeved on an outer side of the spindle and the sleeve portion, a periphery wall of the sleeve portion is provided with a through groove, an outer periphery of the end of the spindle inserted into the sleeve portion is provided with an annular stop groove, a stop element is further provided to limit rotation of the spindle in an axial direction, the stop element is assembled in the stop groove and is lock connected to the through groove.

2. The handle rotating switch shower head according to claim 1, further comprising a sealing element, the sealing element is provided on the spindle, the spindle rotates to make the sealing element close one set of water diversion holes or close part of the water diversion holes of at least two sets of the water diversion holes at the same time.

3. The handle rotating switch shower head according to claim 1, wherein the head portion comprises a main body and a cover component disposed to the main body, the inlets are provided in the cover component, the main body is provided with a hollow connecting portion, the inlets are positioned corresponding to the connecting portion, the water diversion cavities extend out of the handle and run through the connecting portion to be inserted into the main body, the water diversion cavities are connected to the inlets.

4. The handle rotating switch shower head according to claim 3, wherein an annular lock groove is disposed at an outer periphery of each of the at least two water diversion cavities, the lock groove is disposed in the main body, a lock element is provided, the lock element is locked to the lock groove, a lateral width of the lock element is larger than that of the connecting portion.

5. The handle rotating switch shower head according to claim 3, wherein a protruding block is provided at an inner wall of the connecting portion, two adjacent ones of the at least two water diversion cavities of the water diversion body are disposed with a groove which can be coupled to the protruding block.

6. The handle rotating switch shower head according to claim 1, wherein a top end portion of the sleeve portion is provided with a stop block, an outer periphery of the spindle has two protruding stop ribs, which can contact with and couple to the stop block so as to limit the rotating angle of the spindle.

7. The handle rotating switch shower head according to claim 1, wherein an inner periphery face of the handle has an elongated protruding rib, an outer periphery of the other end of the spindle is provided with an elongated groove, which can be coupled to the protruding rib.

8. The handle rotating switch shower head according to claim 1, wherein the outer periphery of the end of the spindle inserted into the sleeve portion is concaved with an assembly chamber, the sleeve portion is provided with at least three lock holes, a lock pin and a spring are provided, the lock pin is movably attached to the assembly chamber and can be coupled to the lock holes respectively, the spring being arranged between the lock pin and the assembly chamber.

9. The handle rotating switch shower head according to claim 1, comprising: a first water diversion hole set and a second water diversion hole set, the first water diversion hole set comprises two pairs of first water diversion holes, the second water diversion hole set comprises two pairs of second water diversion holes.

* * * * *